US008075283B2

(12) United States Patent
Shaw

(10) Patent No.: US 8,075,283 B2
(45) Date of Patent: Dec. 13, 2011

(54) OIL BALANCE SYSTEM AND METHOD FOR COMPRESSORS CONNECTED IN SERIES

(75) Inventor: David N. Shaw, East Falmouth, MA (US)

(73) Assignee: Hallowell International, LLC, Bangor, ME (US)

( * ) Notice: Subject to any disclaimer, the term of this patent is extended or adjusted under 35 U.S.C. 154(b) by 845 days.

(21) Appl. No.: 12/143,172

(22) Filed: Jun. 20, 2008

(65) Prior Publication Data

US 2008/0283133 A1 Nov. 20, 2008

Related U.S. Application Data

(63) Continuation-in-part of application No. PCT/US2005/034651, filed on Sep. 27, 2005, and a continuation-in-part of application No. 11/952,366, filed on Dec. 7, 2007, now Pat. No. 7,651,322, which is a continuation of application No. 10/959,254, filed on Oct. 6, 2004, now abandoned.

(51) Int. Cl.
*F04B 39/04* (2006.01)
*F04B 39/06* (2006.01)

(52) U.S. Cl. ..... 417/228

(58) Field of Classification Search ..... 417/228, 417/244; 62/84; 184/6.16
See application file for complete search history.

(56) References Cited

U.S. PATENT DOCUMENTS 2,076,332 A * 4/1937 Zercher ..... 417/228
2,243,541 A 5/1941 Swart
2,352,581 A 6/1944 Winkler
2,646,212 A * 7/1953 Kellie ..... 417/228
2,663,164 A 12/1953 Kurtz
2,938,361 A 5/1960 McNatt
3,072,318 A 1/1963 Berger et al.
3,074,249 A 1/1963 Henderson
3,226,949 A 1/1966 Gamache
3,237,852 A 3/1966 Shaw
3,241,746 A 3/1966 Shaw
3,243,101 A 3/1966 Shaw
3,360,958 A * 1/1968 Miner ..... 62/470
3,377,816 A 4/1968 Berger
3,465,953 A 9/1969 Shaw
3,500,962 A * 3/1970 Kocher ..... 184/103.1
(Continued)

FOREIGN PATENT DOCUMENTS

EP 0 106 414 4/1984
(Continued)

OTHER PUBLICATIONS

International Search Report with Written Opinion, PCT/US2005/034651, Date Mailed Feb. 26, 2006.

(Continued)

*Primary Examiner* — Devon C Kramer
*Assistant Examiner* — Amene Bayou

(57) ABSTRACT

A compressor system includes a first compressor, which has a first low side oil sump, in a first shell and a second compressor, which has a second low side oil sump, in a second shell. The first and second compressors are connected in series. There is an oil transfer conduit connected between the first low side sump of the first compressor and the second low side sump of the second compressor. The system also includes a normally open check valve in the oil transfer conduit. Additionally, a bleed is provided to effect oil transfer via the oil transfer conduit when the normally open valve is closed.

16 Claims, 5 Drawing Sheets

U.S. PATENT DOCUMENTS

| | | | | | |
|---|---|---|---|---|---|
| 3,543,880 | A | | 12/1970 | Scott | |
| 3,581,519 | A | * | 6/1971 | Garrett et al. | 62/468 |
| 3,719,057 | A | | 3/1973 | Grant | |
| 3,775,995 | A | | 12/1973 | Conley et al. | |
| 3,785,169 | A | * | 1/1974 | Gylland, Jr. | 62/468 |
| 3,852,974 | A | | 12/1974 | Brown | |
| 3,859,815 | A | | 1/1975 | Kasahara | |
| 3,984,050 | A | | 10/1976 | Gustafsson | |
| 4,180,236 | A | | 12/1979 | Saarem et al. | |
| 4,197,719 | A | | 4/1980 | Shaw | |
| 4,205,537 | A | | 6/1980 | Dubberley | |
| 4,236,876 | A | | 12/1980 | Fraser et al. | |
| 4,268,291 | A | | 5/1981 | Cann | |
| 4,306,420 | A | | 12/1981 | Cann | |
| 4,332,144 | A | | 6/1982 | Shaw | |
| 4,439,121 | A | | 3/1984 | Shaw | |
| 4,530,215 | A | * | 7/1985 | Kramer | 62/84 |
| 4,594,858 | A | | 6/1986 | Shaw | |
| 4,748,820 | A | | 6/1988 | Shaw | |
| 4,753,083 | A | | 6/1988 | Sato | |
| 4,787,211 | A | | 11/1988 | Shaw | |
| 4,833,893 | A | | 5/1989 | Morita | |
| 4,870,831 | A | * | 10/1989 | Kitamoto | 62/84 |
| 4,895,498 | A | * | 1/1990 | Basseggio | 417/426 |
| 4,947,655 | A | | 8/1990 | Shaw | |
| 5,062,274 | A | | 11/1991 | Shaw | |
| 5,094,085 | A | | 3/1992 | Irino | |
| 5,094,598 | A | * | 3/1992 | Amata et al. | 417/533 |
| 5,095,712 | A | | 3/1992 | Narreau | |
| 5,123,254 | A | | 6/1992 | Inoue et al. | |
| 5,191,776 | A | | 3/1993 | Severance et al. | |
| 5,220,806 | A | | 6/1993 | Jaster et al. | |
| 5,236,311 | A | * | 8/1993 | Lindstrom | 417/254 |
| 5,303,561 | A | | 4/1994 | Bahel et al. | |
| 5,410,889 | A | | 5/1995 | Sjoholm et al. | |
| 5,626,027 | A | | 5/1997 | Dormer et al. | |
| 5,634,345 | A | * | 6/1997 | Alsenz | 62/84 |
| 5,657,637 | A | | 8/1997 | Mertens | |
| 5,839,886 | A | * | 11/1998 | Shaw | 417/250 |
| 5,894,739 | A | | 4/1999 | Temos | |
| 5,927,088 | A | | 7/1999 | Shaw | |
| 6,276,148 | B1 | | 8/2001 | Shaw | |

FOREIGN PATENT DOCUMENTS

| | | |
|---|---|---|
| EP | 0 715 077 | 6/1996 |
| JP | 57168082 | 10/1982 |
| JP | 58217162 | 12/1983 |
| JP | 59191856 | 10/1984 |
| JP | 6-213170 | 8/1994 |
| WO | WO 97/32168 | 9/1997 |

OTHER PUBLICATIONS

Second Edition—"Application of Thermodynamics"; Author: Bernard D. Wood; 1982 by Bernard D. Wood; 1991 reissued by Waveland Presss, Inc.; pp. 218-222.

A Technical Handbook from SWEP; "Compact Brazed Heat Exchangers for Refrigerant Applications"; 1993; 1 pages plus cover and back sheets.

"Modern Refrigerating Machines"; Author; I. Cerepnalkovski; Elsevier Science Publishers; 1991; pp. 47-48.

"Refrigeration Principles and Systems—An Energy Approach"; Author: Edward G. Pits; Business News Publishing Company; 1991; pp. 243-245.

"Survey and Comparison of Interstage Cooling Systems for Two-Stage Compression"; Data Sheet, No. 20; May 1979; 3 pgs.

"Standard Refrigeration and Air Conditioning Questions & Answers—Third Edition"; Authors: S. M. Elonka and Q.W. Minich; McGraw-Hill, Inc.; 1983, 1973, 1961; pp. 28-31, 50-53.

"Thermal Environment Engineering—Second Edition"; Author: James L. Threlkeld; Prentice-Hall, Inc.; 1970, 1962; pp. 61-70.

"Theory of Mechanical Refrigeration"; Author: N.R. Sparks; McGraw-Hill Book Company, Inc.; 1938; pp. 111-127.

* cited by examiner

OIL BALANCE SYSTEM AND METHOD FOR COMPRESSORS CONNECTED IN SERIES

CROSS REFERENCE TO RELATED APPLICATIONS

The present application is a continuation-in-part application under 35 U.S.C. §120 of U.S. patent application Ser. No. 11/952,366 filed Dec. 7, 2007, which, in turn, is a continuation of U.S. patent application Ser. No. 10/959,254 filed on Oct. 6, 2004, the entire contents of both of which are incorporated herein by reference and priority to both of which is hereby claimed. This application is also a continuation-in-part of application PCT/US05/34651, filed Sep. 27, 2005, which, in turn, claims priority to U.S. patent application Ser. No. 10/959,254 filed Oct. 6, 2004, the entire contents of both of which are incorporated herein by reference and priority to both of which is hereby claimed.

BACKGROUND OF THE INVENTION

The invention of parent application Ser. No. 10/959,254 relates to an oil balance system for compressors connected in series. More particularly, that invention relates to apparatus and a method for an oil balance system in which each compressor is contained in a separate shell, and in which each oil sump for each compressor is a low side sump, i.e., the inlet to each compressor is open to its respective shell, and the outlet from each compressor is sealed to the compressor.

My prior U.S. Pat. No. 5,839,886, the entire contents of which are incorporated herein by reference, relates to an oil balance system for primary and booster compressors connected in series for a heating/cooling or refrigeration system. The primary compressor has a low side sump, but the booster compressor has a high side sump (i.e., the inlet to the booster compressor is sealed to the compressor, and the outlet from the compressor is open to its shell. An open conduit extends between the oil sumps of the two compressors to transfer oil from the sump of the booster compressor to the sump of the primary compressor when the oil level in the booster compressor exceeds a normal operating level.

My prior U.S. Pat. Nos. 5,927,088 and 6,276,148, the entire contents of both of which are incorporated herein by reference, relate to boosted air source heat pumps especially suitable for cold weather climates. In the systems of these patents, a booster compressor and a primary compressor are connected in series.

Most compressors will entrain and pump out some oil, entrained in the refrigerant, during the normal course of operation. So, for a system of series connected compressors housed in separate casings, the pumped out oil will eventually return to the first compressor in the system, thus tending to raise the oil level in the sump of that compressor. As that oil level rises, this will likely cause the first compressor to pump oil to the inlet to the second compressor, so some oil will be delivered from that first compressor to the second compressor in the system, thus tending to prevent a dangerous loss of lubricant in the second compressor. Various compressor designs react differently in regard to this characteristic of pumping out oil entrained in the refrigerant, and it is known to make modifications to specific designs to enhance the tendency to pump out more oil as the level of oil rises.

However, during the course of operation of a series connected compressor system, such as the heat pump systems of my U.S. Pat. Nos. 5,927,088 and 6,276,148, refrigerant/oil imbalances can occur due to such things as, e.g., defrosting requirements, extreme load changes, etc. These imbalances may lead to unbalancing the oil levels in the two compressors; and this may result in taxing the normal oil balancing tendencies beyond their normal capabilities. Accordingly, it may be desirable to incorporate a specific oil balance system in the series connected compressor system.

In particular regard to the present continuation-in-part application, the advent of big bore, short stroke reciprocating compressors, such as the Benchmark compressors made by Bristol Compressors, makes it desirable to improve on the oil balance system disclosed in parent application Ser. No. 10/959,254, although the improved oil balance system of this invention is not limited to such compressors.

SUMMARY OF THE INVENTION

In accordance with the invention of parent application Ser. No. 10/959,254, an oil balancing system is incorporated in a series connected compressor system, such as the heat pump system of my U.S. Pat. Nos. 5,927,088 and 6,276,148, wherein each compressor is housed in a hermetic casing and has a low side oil sump. An oil transfer conduit extends from the sump of the first compressor in the system (usually the booster compressor) to the sump of the second compressor (usually the primary compressor). When the first compressor is not operating and the second compressor is operating, the pressure within the casing of the first compressor is slightly higher than the pressure within the casing of the second compressor, so oil will, as desired, flow from the sump of the first compressor to the sump of the second compressor when the oil level in the first sump exceeds the height of the oil transfer conduit. However, when both compressors are operating, the pressure in the shell of the second compressor will be much higher than the pressure in the shell of the first compressor, which could cause undesirable oil and/or backflow of compressed gas from the sump of the second compressor to the sump of the first compressor. Accordingly, and most importantly, the oil transfer conduit has a check valve which permits oil flow from the first compressor sump to the second compressor sump, but which prevents oil and/or gas flow from the second compressor sump to the first compressor sump.

In accordance with the invention of this continuation-in-part application, an improved oil balance system is presented that is directed particularly to the prevention of the undesirable accumulation of oil in the sump of the second compressor when both of the compressors are operating. This is preferably accomplished by the incorporation of a bleed through the check valve or a bypass line around the check valve to achieve oil balance flow from the sump of the second compressor to the sump of the first compressor when both compressors are operating without experiencing unacceptable blowback of previously compressed refrigerant vapor from the second compressor casing to the first compressor casing.

BRIEF DESCRIPTION OF THE DRAWINGS

In FIGS. 3-6, parts which are the same as or similar to corresponding parts in FIGS. 1 and 2 are numbered as in FIGS. 1 and 2.

DESCRIPTION OF THE PREFERRED EMBODIMENT

The invention of my parent application and the invention of this continuation-in-part application are described in the context of a boosted air source heat pump as disclosed in my prior U.S. Pat. Nos. 5,927,088 and 6,276,148. However, it will be understood that these invention are applicable to any system of compressors in series where the compressors each have low side oil umps.

Figure 1:
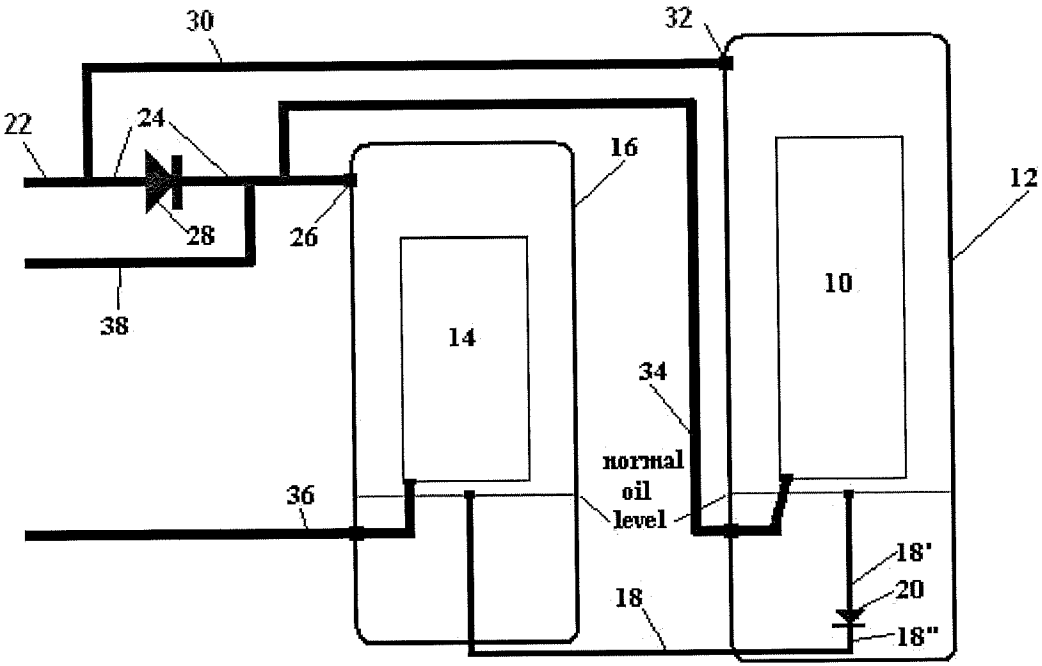
FIG. 1 is a schematic of the oil balance system of the invention of my parent application Ser. No. 10/959,254 and continuation application Ser. No. 11/95,2366.

Referring to FIG. 1, a booster compressor 10 is housed in a hermetically sealed casing 12, and a primary compressor 14 is housed in a hermetically sealed casing 16. The compressors are preferably reciprocating compressors, but rotary or other types of compressors may be used. Each compressor is a low side sump compressor. That is, the inlet to each compressor is open to the shell of the compressor, and the outlet from each compressor is sealed to the compressor. Each compressor/casing has an oil sump at the bottom of the casing, the normal level of which is shown in shown in FIG. 1. The oil in these sumps is used to lubricate the compressors in ways presently known in the art.

An oil balance conduit 18 extends between the compressor shells at the lower parts thereof. Oil balance conduit 18 is positioned just slightly above the normal level of the sump oil in booster casing 12. A normally open check valve 20 is positioned in oil balance conduit 16. Check valve 20 permits oil flow from the sump of booster casing 12 to the sump of primary casing 16 when primary compressor 14 is on and booster compressor 10 is off or when both compressors are off, but prevents oil flow from the sump of primary casing 16 to the sump of booster casing 12 whenever both compressors are on.

A conduit 22 is connected to the low side of a system (e.g., an evaporator in a heating or cooling system), to receive refrigerant from the system low side. A branch conduit 24 is connected to the inlet 26 to primary compressor casing 16 to deliver refrigerant to the interior volume of casing 16 and to primary compressor 14. A check valve 28 in conduit 24 controls the direction of flow in conduit 24. Check valve 28 is preferably normally open to minimize the pressure drop of the fluid flowing through check valve 28 to primary inlet 26. Another branch conduit 30 connects conduit 22 to the inlet 32 to booster compressor casing 12 to deliver refrigerant to the interior volume of casing 12 and to booster compressor 10.

One end of a booster compressor discharge line 34 is sealed to booster compressor 10, and the other end of discharge line 34 is connected to branch conduit 24 downstream of check valve 28, whereby discharge line 34 delivers the discharge from booster compressor 10 to primary inlet 26 and to the interior volume of primary casing 16 and to primary compressor 14.

One end of a primary compressor discharge line 36 is sealed to primary compressor 14 and the other end of discharge line 34 is connected to the high side of the system (e.g., a condenser in a heating or cooling system).

If the system includes an economizer, a conduit 38 would be connected to conduit 24 downstream of check valve 28.

Normally open check valve 20 may be maintained normally open in any chosen manner. Examples may be understood by reference to FIG. 2 where valve 20 has a spherical chamber 40 in the segments 18' and 18" of oil balance line 18. Chamber 40 is divided into upper and lower segments by a wall 42 which has peripheral flow passages 44. A ball 46 is loaded against wall 42 either by the force of gravity, or by a light spring 48 or by magnets 50. Regardless of the mechanism chosen, valve 20 is normally open to permit flow in line 18 from booster casing 10 to primary casing 16 when the pressure in the interior volume of primary casing 16 is essentially equal to or lower than the pressure in the interior volume of booster casing 12. However, if the pressure in the interior of primary casing 16 is substantially higher than the pressure in the interior volume of booster casing 12, ball 46 will be moved to engage a conical or spherical seat 52 to close the entrance from line 18' to the upper segment of chamber 40, thus blocking flow in oil balance line 18. In the operation of this invention, check valve 20 must be open when primary compressor 14 is on and booster compressor 10 is off, and when both the primary compressor 14 and the booster compressor 10 are off; and check valve 20 must be closed when both the primary compressor and the booster compressor are on.

Normally open check valve 28 may be held normally open in the same manner as valve 20 if it is also mounted vertically. However, if valve 28 is mounted horizontally, spring or magnetic loading will be required.

When both primary compressor 14 and booster compressor 10 are off, the gas pressure in primary shell 16 and in booster shell 12 will be equal. Accordingly, oil flow in balance line 18 will be bi-directional depending on the oil heads in the sumps of the primary and booster shells.

In the heating mode of operation, the booster compressor is off and only the primary compressor is operating at low heating load on the system. In this situation, normally open check valves 20 and 28 are open; and the pressure in booster shell 12 is slightly higher than the pressure in primary shell 16. Therefore, if the oil level in the sump of booster shell 12 is higher than its intended normal level, which means that the oil level in the sump of primary shell 16 is lower than normal, oil will flow via balance line 18 from the sump of booster shell 12 to the sump of primary shell 16 to restore normal oil levels in both sumps. Also, if the oil level in the sump of primary shell 16 is very high, which means that the oil level in the sump of booster shell 12 is low, and the pressure drop between the sump of booster shell 12 and the sump of primary shell 16 is low enough, oil can flow via balance line 18 from the sump of primary shell 16 to the sump of booster shell 12.

At higher heating loads on the system, both the booster compressor and the primary compressor will be operating. In that situation, the pressure in the primary shell will be higher than the pressure in the booster shell, because the discharge from booster compressor 10 will be delivered via line 34 to casing 16, check valve 28 will be closed, and system low side will be connected via conduits 22 and 30 to the inlet 32 to booster shell 12. Accordingly, normally open check valve 20 will be closed, thus preventing back-flow of compressed gas (which would go from the discharge of booster compressor 10 to primary shell 16 and then back to booster shell 12 via balance line 18 if check valve 20 were open). However, the closure of check valve 20 also prevents oil balance flow via line 18, which can lead to oil imbalance in the sumps of the compressors, particularly creating a concern about low oil level in the sump of primary shell 16.

Some oil becomes entrained in the circulating refrigerant during the operation of the system. When both booster compressor 10 and primary compressor 16 are on, all oil entrained in the refrigerant is delivered to the shell 12 of booster compressor 10, where it tends to separate out and fall into the sump of booster shell 12. If the oil accumulates in the sump of booster shell 12 above the predetermined normal level, operation of the booster compressor will tend to agitate the oil to create a mist that will be entrained in the refrigerant discharged from booster compressor 10. This entrained oil will be delivered to the interior of primary shell 16, where it will tend to drop out from the gas due to differences in gas and oil velocities upon entering into the interior of primary shell 16. This separated oil will fall into the sump of primary shell 16 to replenish the level of oil in this sump.

Since this concern about low oil level in the sump of primary shell 16 occurs only when both the booster and primary compressors are operating, other steps can be taken to address the potential problem in addition to relying on the mist and precipitation action described in the preceding paragraph. One solution is to program the system to turn off the booster compressor for a short time (on the order of 2-4 minutes). As described above for the operational state where the primary compressor is on and the booster is off, this will result in opening normally open valve 20, and any oil built up above normal level in the sump of booster shell 12 will be transferred to the sump of primary shell 16 via transfer line 18.

Also, during defrost cycling and cooling operation, the booster compressor is off, and only the primary compressor is operating. Thus, normally open check valve 20 will be open, and oil balance transfer can take place from the sump of booster shell 12 to the sump of primary shell 16.

Turning now to the subject matter of this continuation-in-part application, there are operating conditions and circumstances, such as, for example, too frequent defrosting, or restarting after an extended power outage, whereby excess oil may have previously accumulated in the sump of the primary compressor. If both compressors are subsequently required to operate, it will be desirable to transfer oil via oil balance line 18 from the sump of the primary compressor casing 16 to the sump of the booster compressor casing 12 to achieve and maintain oil balance between the sumps of the two compressors. In accordance with the invention of my parent application, oil transfer via balance line 18 is prevented when both compressors are operating because check valve 20 is closed when both compressors are operating. However, in accordance with the invention of this continuation-in-part application, the closure of check valve 20 is bypassed to permit oil transfer via balance line 18 from the sump of primary compressor casing 16 to the sump of booster compressor casing 12 to achieve oil balance between both sumps when both compressors are operating, without encountering unacceptable back-flow of compressed gas from primary shell 16 to booster shell 12.

Figure 3:
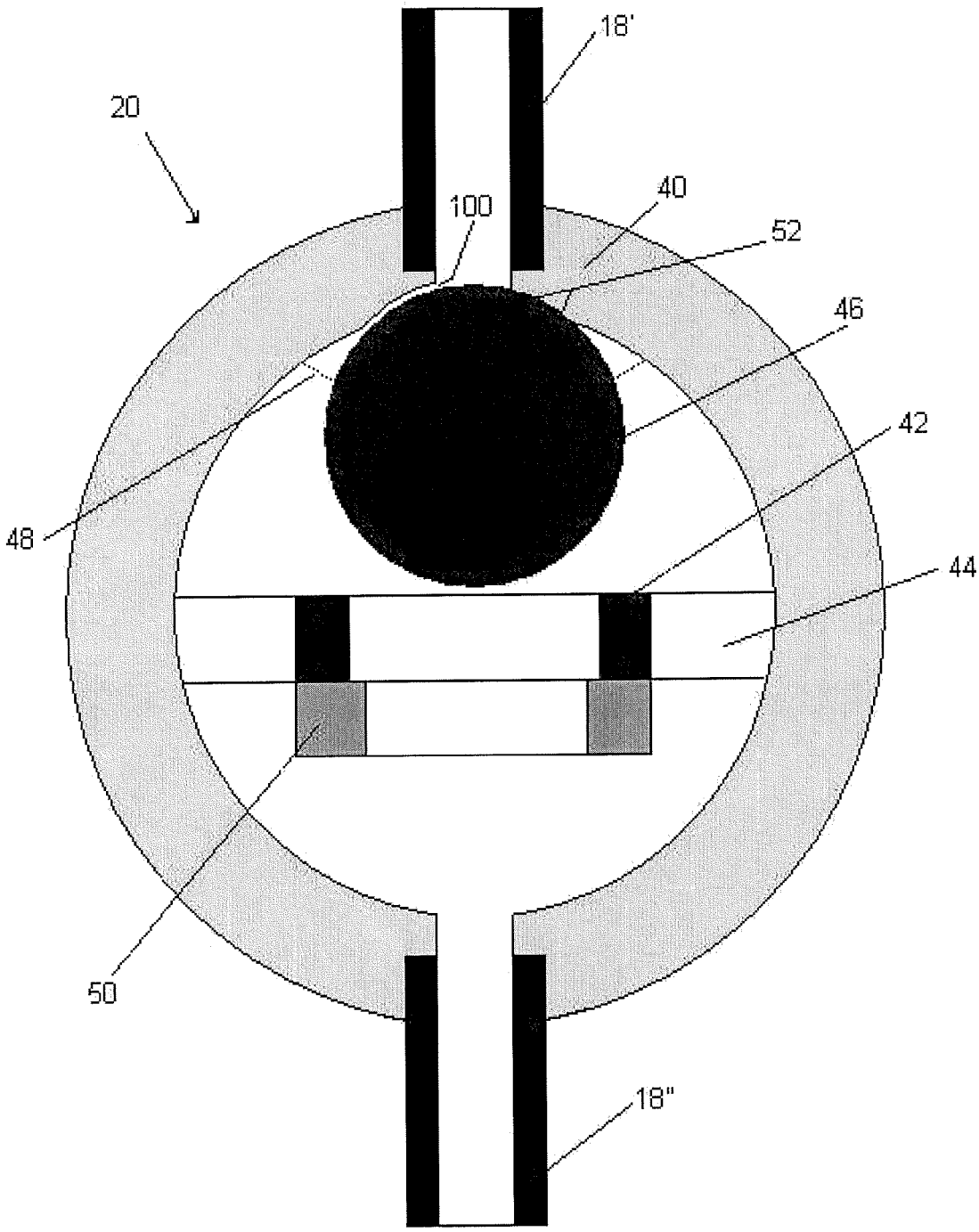
FIG. 3 is an enlarged sectional view similar to FIG. 2 of a modified oil balance check valve in accordance with this continuation-in-part invention.

Referring to FIG. 3, the first, and preferred, embodiment for bypassing the closed state of check valve 20 is shown. In FIG. 3, normally open flow control valve 20 is shown in its closed position, where ball 46 is seated in its conical seat 52. However, a small bypass bleed channel 100 is formed in conical seat 52, as by machining, forging or other suitable techniques, to establish a bleed channel connection from the upper interior part of chamber 40 of valve 20 to line 18', and hence to the sump of booster compressor casing 12. Accordingly when, both booster compressor 10 and primary compressor 14 are operating, which causes normally open valve 20 to be moved to its closed position because of the higher pressure in the sump of primary compressor casing 16 than the pressure in the sump of booster compressor casing 12, bleed channel 100 establishes a bypass path for the flow of oil past what would otherwise be a closed valve 20. Bearing in mind that the pressure in the sump of primary compressor casing 16 is higher than the pressure in the sump of booster compressor casing 12 when both compressors are operating, an accumulation of oil above the normal level in the sump of primary casing 16 will result in oil flow from the sump of primary compressor casing 16 to the sump of booster compressor casing 12 via oil transfer line 18 and segment 18" to the interior of chamber 40 of valve 20, and then via bleed channel 100 to oil transfer line segment 18'and to the sump of booster compressor shell 12 to balance the oil levels in the sumps of the two compressor casings. Since bleed channel 100 is relatively small compared to the size of oil balance line 18 (on the order of ½ of 1% of its flow area), bleed channel 100 permits this bypass flow of oil past the otherwise closed valve 20 without permitting an unacceptable amount of back-flow of compressed gas from primary shell 16 to booster shell 12. Bleed channel 100 is self cleaning because any flow impeding debris will immediately be removed every time valve 20 opens. Any probability of total flow blockage is essentially eliminated by use of a channel instead of a very small unfiltered orifice.

Figure 4:
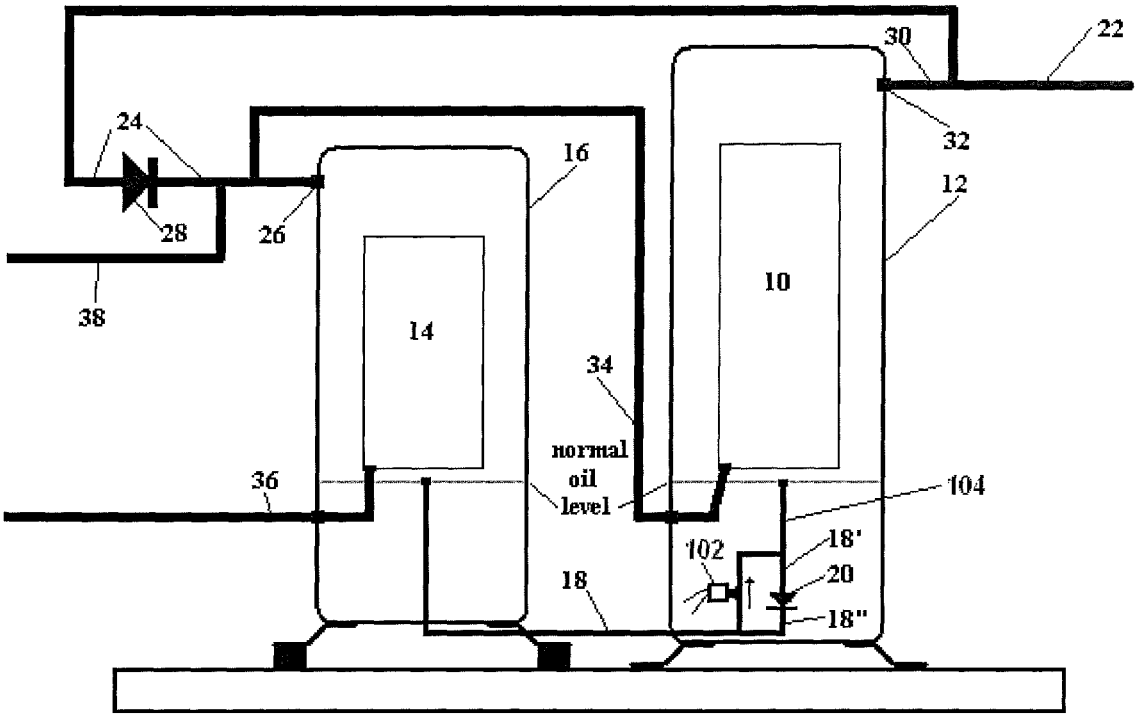
FIG. 4 is a schematic of a modified oil balance system of this continuation-in-part invention.

Referring now to FIG. 4, another embodiment is shown for bypassing closed valve 20. In this embodiment, a solenoid operated valve 102 is positioned in a bypass line 104 around valve 20 of FIG. 2, bypass line 104 being connected between conduit 18 and branch 18'. When both compressors are off, or when only primary compressor 14 is on, and valve 20 is in its normally open state, solenoid valve 102 is closed. However, when both compressors are operating and valve 20 is closed, a system controller is programmed to open solenoid valve 102 is opened on a time schedule to permit excess oil in the sump of primary casing 16 to flow from the sump of primary compressor casing 16 to the sump of booster compressor casing 12. The oil flow is from the sump of primary casing 16 to oil balance conduit 18 to bypass line 104 to conduit segment 18' to the sump of booster casing 12. The flow volume of bypass line 104 is large enough to allow high flow rates and is not susceptible to blocking. Solenoid 102 is opened only at predetermined times, and then only for short periods of time, such as upon termination of a defrost cycle when booster compressor operation is called for along with primary compressor operation. Alternatively an oil level sensor on the primary casing could be used to open solenoid valve 102 when both compressors are operating and the oil level in the primary sump rises above a predetermined level. Another example of when solenoid valve 102 might be open would be if the booster compressor is a scroll compressor and the primary compressor is a reciprocating compressor, and if the normal entrained oil pumping rate of the booster is higher than that of the primary. When both compressors are operating, the oil level will rise in the sump of the primary compressor until its entrained oil pumping rate matches what is coming to it from the booster. A relatively minor problem resulting from this situation would be excessive power consumption of the primary compressor as its running parts become submerged in oil. A far worse problem would be an impact on primary compressor reliability and oil starvation of the booster compressor as it loses oil to the primary compressor. Programmed opening of solenoid valve 102 to permit oil transfer from the sump of the primary compressor to the sump of the booster compressor will prevent these problems.

Figure 2:
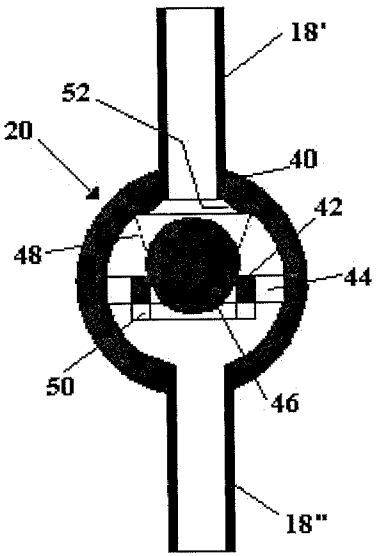
FIG. 2 is a sectional view of the oil balance check valve of FIG. 1.
Figure 6:
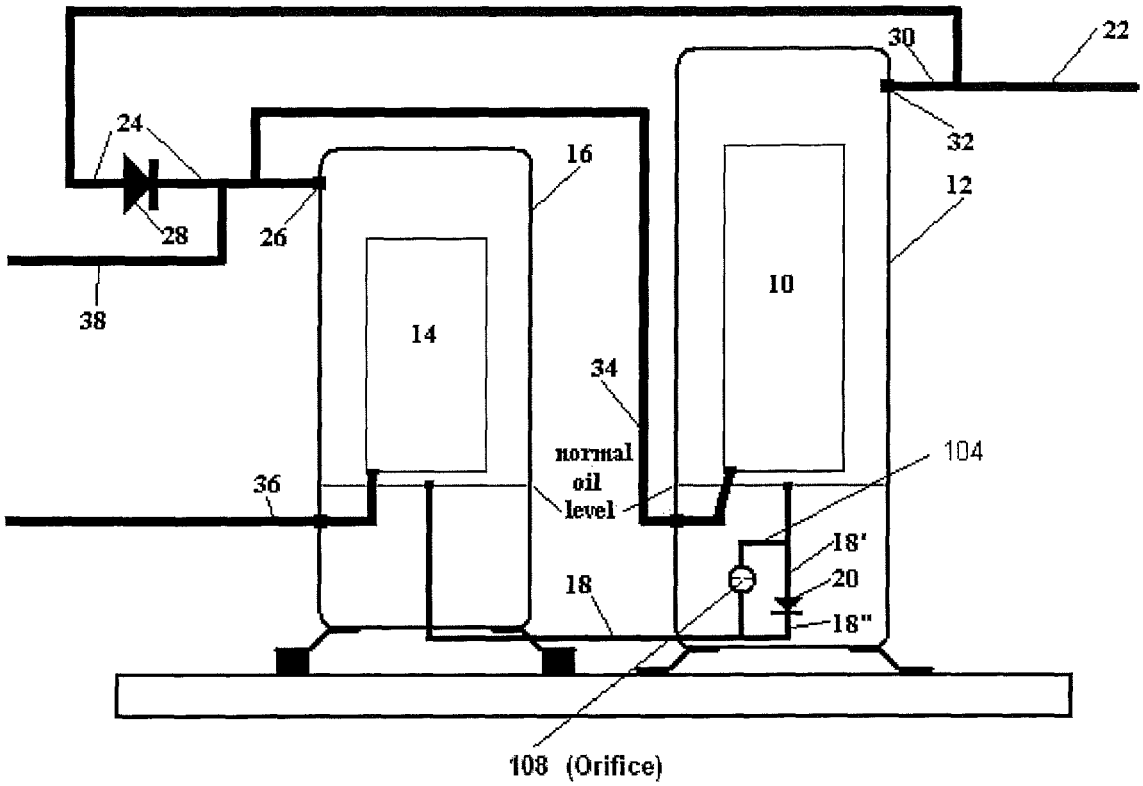
FIG. 6 is a schematic of another modified oil balance system of this continuation-in-part invention.

Referring now to FIG. 6, another embodiment is shown for bypassing closed valve 20. In this embodiment valve 20 of FIG. 2 is bypassed by a small fixed orifice 108 in bypass line 104 connected around valve 20 from conduit 18 to conduit branch 18'. The small fixed orifice 108 permits oil flow from the sump of primary casing 16 to the sump of booster casing 12 when both compressors are on, valve 20 is closed, and oil accumulates over the normal oil level in primary casing 16. The oil flow is from the sump of primary casing 16 to oil balance conduit 18 to bypass line 104 through fixed orifice 108 to branch conduit 18' to the sump of booster casing 12. As with bypass line 100, bypass line 104, and capillary tube 106, the flow volume through small fixed orifice 108 is small enough to prevent an unacceptable back-flow of compressed gas from primary casing 16 to booster casing 12.

Figure 5:
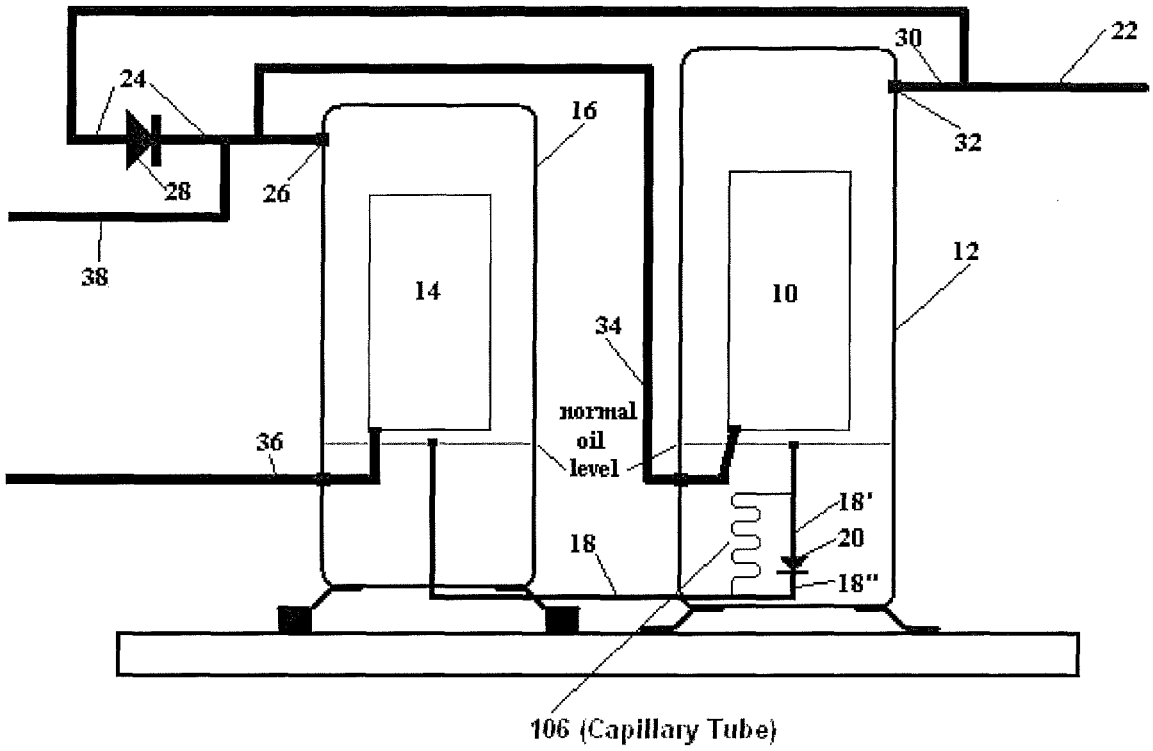
FIG. 5 is a schematic of another modified oil balance system of this continuation-in-part invention.

If the capillary of the embodiment of FIG. 5 or the fixed orifice of the embodiment of FIG. 6 is used, a strainer should be positioned upstream (in the direction of bypass flow) of the orifice or the capillary to avoid blocking of the bypass line with debris.

It should be noted that in the embodiments of this continuation-in-part application the positions of conduits 22, 24, and 30 have been modified (relative to FIG. 1), as seen in FIGS. 4-6, to reflect current practice. This modification is intended to cause a majority of the oil circulating in the system to be returned to the sump of booster compressor casing 12. It should also be noted that for each of the embodiments of FIGS. 3-6, which are directed to the situation where both compressors are operating and normally open valve 20 is closed, oil transfer between the sumps of the booster and primary compressors via oil balance conduit 18 will be as described for FIGS. 1 and 2 when both compressors are off or when only the primary compressor is on, and valve 20 is in its normally open condition.

While a preferred embodiment of the present invention has been shown and described, various modifications and substitutions may be made thereto without departing from the spirit and scope of the invention. Accordingly, it is to be understood that the present invention has been described by way of illustration and not limitation.

What is claimed is:

1. A compressor system comprising:

a first compressor in a first casing, said first compressor having a first low side lubricant sump;

a second compressor in a second casing, said second compressor having a second low side lubricant sump;

said first and second compressors being connected in series;

a lubricant transfer conduit connected between said first low side sump of said first compressor and said second low side sump of said second compressor;

a normally open check valve in said lubricant transfer conduit;

said normally open check valve permitting lubricant flow between both of said lubricant sumps when both of said compressors are off;

said normally open check valve permitting lubricant flow from said first lubricant sump to said second lubricant sump when said first compressor is off and said second compressor is on said normally open check valve being closed when both of said compressors are on; and a bypass associated with said check valve to permit lubricant flow from said second compressor casing to said first compressor casing when said normally open check valve is closed.

2. A compressor system as in claim 1 wherein:

said compressor system is a heat pump system, said first compressor being a booster compressor and said second compressor being a primary compressor.

3. A compressor system as in claim 1 wherein:

said first casing has a first inlet connected to receive gas from a low side of the system, and said second casing has a second inlet connected to receive gas from the low side of the system, said first compressor has a discharge line connected at one end to said first compressor and connected at the other end to said second inlet of said second shell; and said second compressor has a discharge line connected at one end to said second compressor and at the other end to a high side of the system.

4. A compressor system as in claim 1 wherein:

said bypass is a bleed in said check valve.

5. A compressor system as in claim 1 wherein:

said check valve has a seat and a moveable element that contacts said seat to close said check valve; and said bypass is a bleed channel in said seat.

6. A compressor system as in claim 1 wherein said bypass includes:

a bypass line connected at opposite ends to said lubricant transfer conduit around said normally open check valve; and a flow control valve connected to said bleed line to permit lubricant flow around said check valve from said second sump to said first sump when said check valve is closed.

7. A compressor system as in claim 6 wherein:

said flow control valve is a solenoid valve.

8. A compressor system as in claim 1 wherein said bypass includes;

a capillary tube connected at opposite ends to said lubricant transfer conduit around said normally open check valve;

said capillary tube permitting lubricant flow from said second sump to said first sump around said check valve when said check valve is closed.

9. A compressor system as in claim 1 wherein said bypass includes:

a bypass line connected at opposite ends to said lubricant transfer conduit around said normally open check valve; and a flow control orifice in said bypass line to permit lubricant flow from said second lubricant sump to said first lubricant sump when said check valve is closed.

10. A method for effecting oil balance in a compressor system, including the steps of:

establishing a first compressor in a first casing having a first low side lubricant sump;

establishing a second compressor in a second casing having a second low side lubricant sump;

said first and second compressors being connected in series;

positioning a lubricant transfer conduit between said first low side lubricant sump and said second low side lubricant sump;

positioning a normally open check valve in said lubricant transfer conduit;

said normally open check valve permitting flow in both directions in said lubricant transfer conduit between said first low side lubricant sump and said second low side lubricant sump when both of said compressors are off;

said normally open check valve permitting flow in said lubricant transfer conduit from said first low side lubricant sump to said second low side lubricant sump when said first compressor is off and said second compressor is on;

said normally open check valve being closed when both of said compressors are on; and positioning a bypass associated with said check valve to permit lubricant flow from said second compressor sump to said first compressor sump when both of said compressors are on.

11. The method of claim 10 wherein said step of positioning a bypass associated with said check valve includes;

forming a bleed in said check valve.

12. The method of claim 10 wherein;

said check valve has a seat and a moveable element that contacts said seat to close said check valve; and wherein said step of positioning a bypass associated with said check valve includes;

forming a bleed channel in said seat.

13. The method of claim 10 wherein said step of positioning a bypass associated with said check valve includes:

positioning a bypass line connected at opposite ends to said lubricant transfer conduit around said normally open check valve; and positioning a flow control valve in said bypass line to permit lubricant flow around said check valve from said second lubricant sump to said first lubricant sump when said check valve is closed.

14. The method of claim 13 wherein said step of positioning a flow control valve in said bleed line includes:

positioning a solenoid valve in said bleed line.

15. The method of claim 10 wherein said step of positioning a bypass associated with said check valve includes:

positioning a capillary tube connected at opposite ends to said lubricant transfer conduit around said normally open check valve; and said capillary tube permitting lubricant flow from around said check valve from said second lubricant sump to said first lubricant sump when said check valve is closed.

16. The method of claim 10 wherein said step of positioning a bypass associated with said check valve includes:

positioning a bypass line connected at opposite ends to said lubricant transfer conduit around said normally open check valve; and positioning an orifice in said bypass line to permit lubricant flow around said check valve from said second lubricant sump to said first lubricant sump when said check valve is closed.

* * * * *